United States Patent [19]

Pittman et al.

[11] Patent Number: 4,793,816

[45] Date of Patent: Dec. 27, 1988

[54] TERMINAL PROTECTOR FOR CIRCUIT BOARD CONNECTOR

[75] Inventors: Robert B. Pittman, Hackensack, N.J.; Michael Offerman, Merrick, N.Y.

[73] Assignee: Industrial Electronic Hardware, New York, N.Y.

[21] Appl. No.: 75,592

[22] Filed: Jul. 20, 1987

[51] Int. Cl.[4] ..... H01R 23/70

[52] U.S. Cl. ..... 439/79

[58] Field of Search ..... 439/55, 78–83, 439/629–637

[56] References Cited

U.S. PATENT DOCUMENTS

| | | | |
|---|---|---|---|
| 3,208,026 | 9/1965 | Ruehlemann | 439/83 |
| 3,976,850 | 8/1976 | Faber et al. | 200/51.1 |
| 4,390,224 | 6/1983 | Showman et al. | 439/79 |
| 4,487,464 | 12/1984 | Kirschenbaum | 439/62 |
| 4,550,962 | 11/1985 | Czeschka | 29/739 |
| 4,591,221 | 5/1986 | De Brouchere et al. | 439/511 |
| 4,734,042 | 3/1988 | Martens et al. | 439/65 |

*Primary Examiner*—Neil Abrams

*Attorney, Agent, or Firm*—James & Franklin

[57] ABSTRACT

A protector for use with a circuit board connector having exposed terminals to be electrically connected to terminal pads on an inserted circuit board, the protector partially housing the individual terminals of the connector, thereby to maintain them separated and properly located and insulate them against distortion and damage during handling, shipping, soldering and inserting the circuit board. The protector has walls inserted between contacts, and preferably two cooperating protector halves are utilized, one inserted from each side of the connector.

26 Claims, 9 Drawing Sheets

TERMINAL PROTECTOR FOR CIRCUIT BOARD CONNECTOR

The present invention relates to a protective structure adapted to be associated with a circuit board connector into which a circuit board is adapted to be inserted, thereby to make multiple electrical connections with the connector terminals. The protector and the terminals which are exposed on the connector intermesh, the connector terminals being housed in pockets defined by the protector while being exposed in those pockets so that access can be had to them for effecting electrical connection to the terminal pads on the circuit board while ensuring the integrity of the terminals.

An important class of printed circuit board connectors comprise a housing from which a plurality of relatively closely spaced conductive terminals extend, usually in two opposed rows of appreciable length. A member having a corresponding number of terminal pads exposed thereon and carrying appropriate circuitry (here generically termed "circuit board", although it may or may not be board-like in structure) is adapted to be associated with the connector, usually by being inserted between the rows of connector terminals, so that each terminal engages an appropriate terminal pad on the board. It is important for the proper functioning of the apparatus involved that the electrical connections between the terminals on the connector and board be secure and effective. Sometimes mere physical pressure derived from the resiliency of the connector terminals is relied upon to hold the board on the connector and produce proper electrical connections, bu increasingly more frequently the physical securement, and in particular the electrical connection, is achieved by means of soldering, often involving a re-flow process which may or may not include a vapor phase technology. It is of course essential that the terminals on the connector register accurately with the terminal pads on the board, a requirement which becomes more critical as the number of terminal-terminal pad combinations, and particularly their spatial density, increases, and the requirements of modern electronic equipment, featuring miniaturization and compactness, do require large numbers of contact pairs closely arranged with a high spatial density.

Hence providing electrical connectors for use with boards of the type under discussion, and particularly electrical connectors where the terminals extend therefrom in a row with the terminals of that row closely spaced over an appreciable length, presents obvious problems. The connectors must be provided to the user with the terminals accurately positioned so as not to shortcircuit one another and to register with the proper terminal pads on the board, yet because those terminals extend from the body of the connector they are exposed to damage and distortion during shipping, storage and handling. Moreover it is often desired that the supplier provide his customer with solder-dipped terminals, and the solder-dipping step intensifies the requirement that the terminals be properly spaced from one another at that point in time, because if they are too closely spaced, even if not actually touching, the solder-dipping operation may result in bridging the gap between two adjacent terminals, thus producing an unacceptable short circuit when electrically energized. And when the connector is received by the user, who associates it with an appropriate circuit board and completes the multiplicity of separate electrical connections that are involved, the user should be able to accomplish that result simply by inserting the board into the connector so as to engage the terminal, and without having to individually manipulate any of the terminals to ensure that each of them engages, and is ultimately soldered to, the proper conductive pad on the board.

Hence a protector for board connectors of the type under discussion optimally should not only ensure that the terminals are properly located and spaced when the product is shipped but must also be effective before it is shipped and during the presolder dipping, and it must not interfere with the proper association of the connector with the board nor, when that is desired, with the making of solder connections between the terminals and the appropriate board pads. The need for protection during pre-solder dipping, board insertion and soldering greatly complicates the terminal protection problem. Merely encasing the terminals would protect them during shipping and handling, but not during pre-solder dipping, boar insertion or final soldering. The protector here disclosed performs all of the above-enumerated functions.

Connectors of the type under discussion are ordinarily provided in a wide variety of lengths for applications requiring different numbers of circuits and connections. To provide different protectors for each different connector size would be costly, particularly if the protectors are to be made of molded plastic, as is probably economically inevitable, since the cost of individual molds or dies for each of the many different sizes involved would involve considerable expense. The protector here disclosed can be mass produced in a form usable with many different sizes of connectors.

In accordance with the present invention a simple molded piece is provided with pockets into which the individual connector terminals are received but from which those terminals also extend so as to be accessible, the pockets separating the terminals from one another so as to prevent physical dislocation of the connectors, while nevertheless exposing the terminals to pre-solder dipping when that is desired and positively preventing any conductive bridging between adjacent terminals as a result of the dipping. The protector remains associated with the connector and its terminals during shipment and then, when the connector is at its place of use, permits the circuit board to be inserted into engagement with the terminals while still retaining the terminals in its pockets so as to ensure that the terminals are properly and accurately located in registration with the appropriate terminal pads on the board an permitting physical engagement of terminals and pads. On those occasions where soldering of the terminals to the pads is desired, that soldering can be carried out while the protector is in place, thus ensuring proper registration of the terminals with the corresponding conductive pads throughout that operation. Thereafter the protectors can, if desired, be removed from the connector and discarded or reused.

It is the prime object of the present invention to devise a terminal protector for a circuit board connector which will do one or more of the following: ensure that the exposed terminals on the connector will remain in proper position from initial manufacture through pre-shipping procedures and shipping, and then through circuit board insertion and soldering, all without materially interfering with any of those operations.

It is a further object of the present invention to provide such a protector which may be manufactured inexpensively in a form such that it can be used with connectors of different sizes.

To the accomplishment of the above, and to such other objects as may hereinafter appear, the present invention relates to a protector for the exposed terminals of a circuit board connector as defined in the following claims and as described in this specification, taken together with the accompanying drawings in which:

Figure 1:
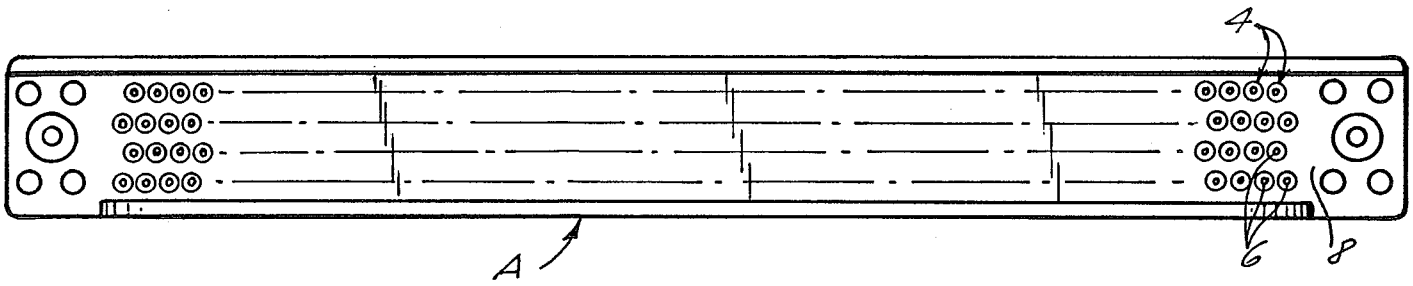
FIG. 1 PRIOR ART
FIG. 1 is a side elevational view of a typical circuit board connector with exposed terminals with which the protector of the present invention is to be used.
Figure 2:
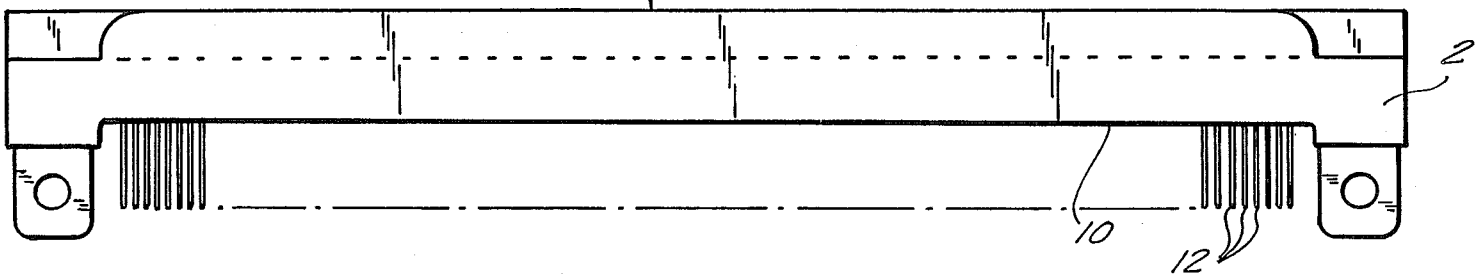
FIG. 2 PRIOR ART
FIG. 2 is a bottom view of the connector of FIG. 1.

A typical electrical connector, generally designated A, with which the terminal protector of the present invention is adapted to be used, is shown in FIGS. 1 and 2. It comprises a body 2 of insulating material, usually molded plastic, within which is housed and from which extend a large number of closely spaced terminals generally designated 4. Tails 6 from those terminals extend from a lower surface 8 of the body, and it is to those tails that external electrical connections to wires or the like are made. In place of the extending tails 6, which define male-type terminal portions, corresponding sockets could be provided for effecting female-type terminal portions. Extending up from the upper surface 10 of the body 2 are terminal portions 12, one from each terminal 4, which are adapted to receive a circuit board and make electrical connection with contact pads on that board. It is with these upwardly extending terminal portions 12 that the protector of the present invention is designed to cooperate.

Figure 5:
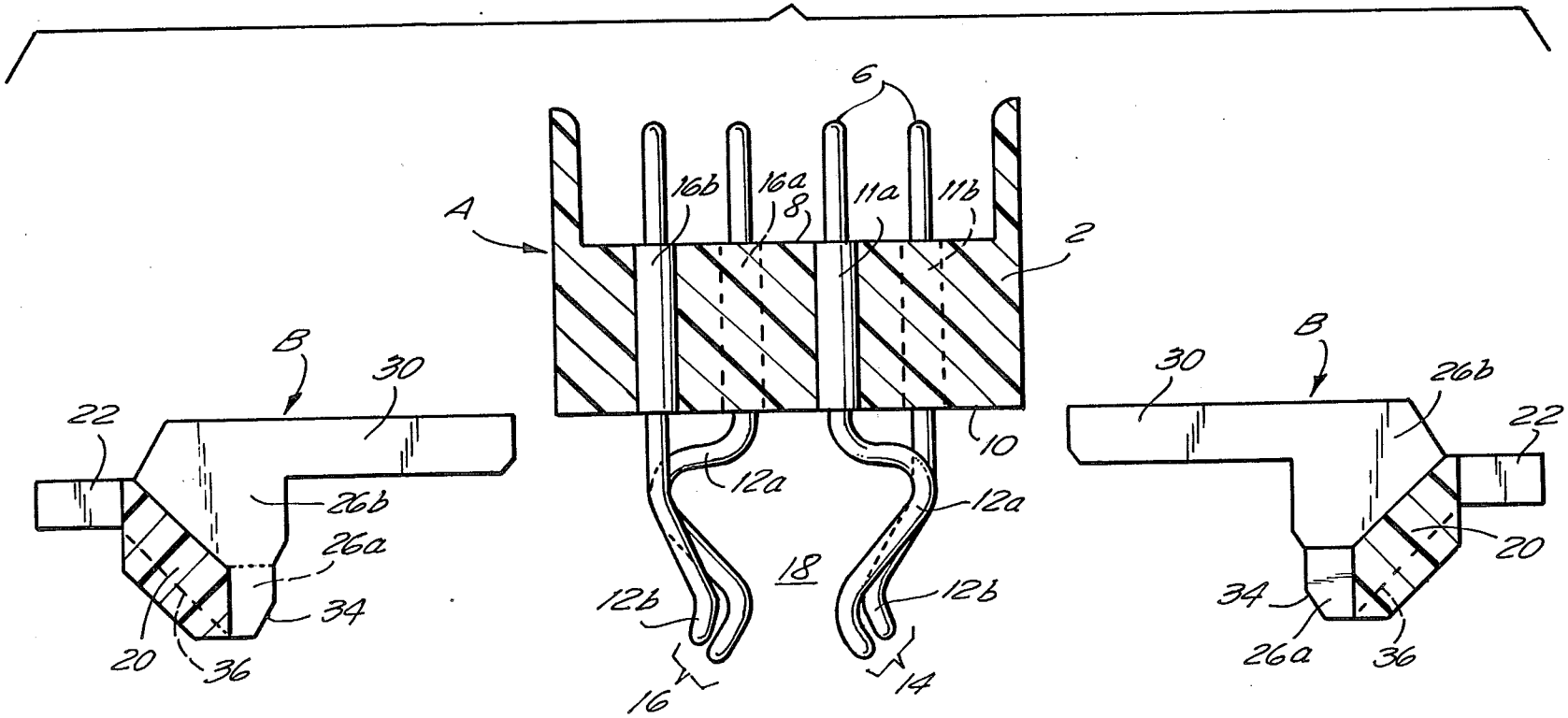
FIG. 5 is a cross-sectional view of the connector of FIG. 1 and showing cross-sectional views of two, right and left side, protectors of the present invention, each designed to be inserted from a different side of the connector.
Figure 6:
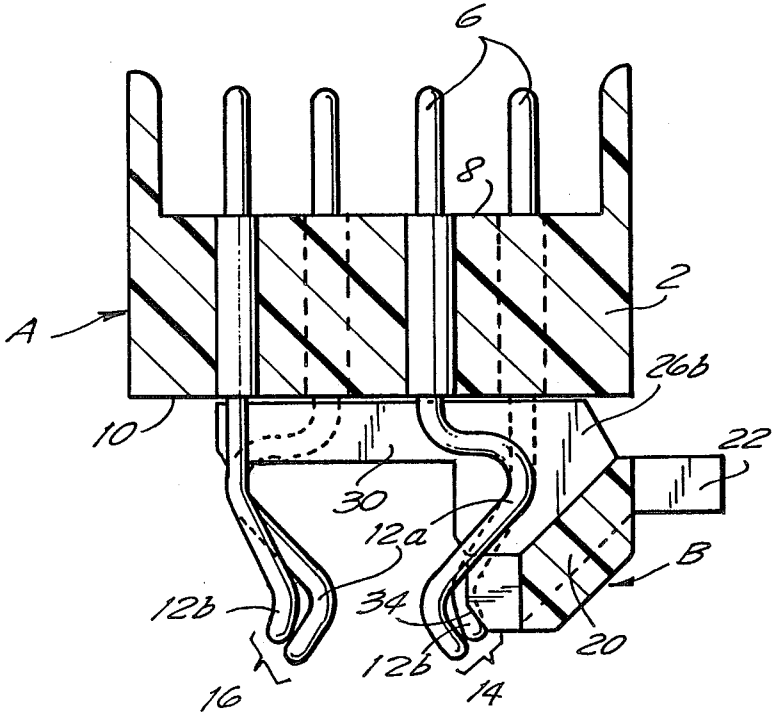
FIG. 6 is a view similar to FIG. 5 but showing the left side protector in position.
Figure 7:
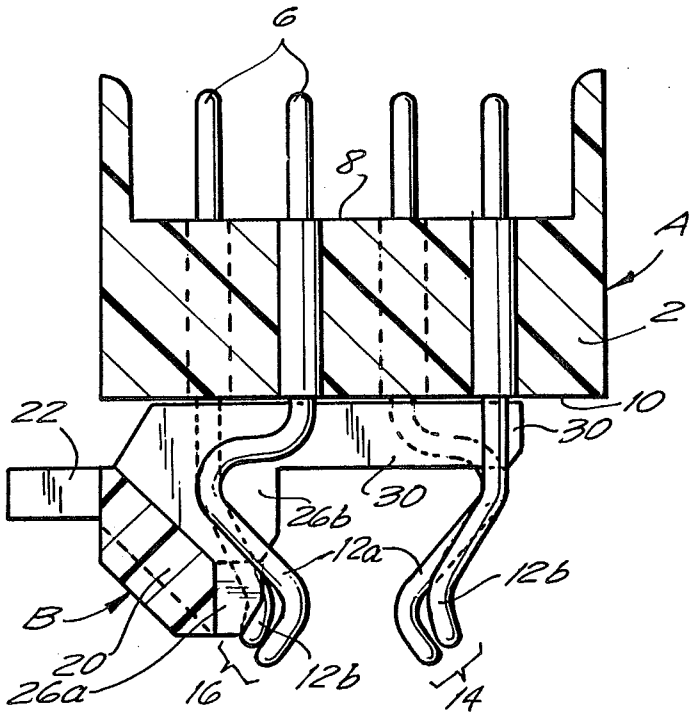
FIG. 7 is a view similar to FIG. 5 but showing the right side protector in position.

As may perhaps best be seen from FIG. 5, the extending terminal portions 12 are arrange along the length of the connector body 2 in two rows 14 and 16 laterally separated so as to define a space generally designated 18 into which the external circuit board is adapted to be received. In order to increase the terminal density, the terminal portions 12 of each of the rows 14 and 16 are laterally staggered, as they are received in and project from the body 2, to define sub-rows consisting of the terminal portions 12*a* and 12*b* respectively. In this way terminals may in effect be spaced from one another by 0.075 inch although the center line spacing along the length of the body is 0.0375 inch. Because of this sub-row organization the upwardly extending terminal portions 12*a* are differently shaped from the terminal portions 12*b*, as is clearly shown in FIG. 5, so that the end segments of the terminal portions 12*a* and 12*b* of a given row are in approximately the same position laterally of the connector body 2, and it is those end segments which engage and make electrical connection with the circuit board when the latter is inserted between the end segments of the two rows 14 and 16. Thus each of the terminal portion rows 14 and 16 consists of a large number of closely spaced conductive wire-like parts, those parts having a significant degree of resilient flexibility. They are so shaped that the space 18 between the end segments of the two rows 14 and 16 is somewhat less than the thickness of the circuit board to be used therewith, so that when the circuit board is inserted it will engage the terminal portions 12*a* and 12*b* and resiliently spread them apart, the resiliency of those terminal portions producing the desired pressure contact between each of the terminals and its respective conductive pad on the circuit board.

It will be appreciated that because of the very close spacing of the terminal portions 12 in each of the rows 14 and 16, which in the typical example here given will be only a very few hundredths of an inch, and because those terminal portions 12 extend from the body 2 for appreciable distances, usually amounting to several tenths of an inch, those terminal portions 12 are extremely subject to distortion and dislocation during shipment, handling, circuit board insertion and, as is usual, soldering the terminal portions to the conductive pads on the circuit board.

Figure 3:
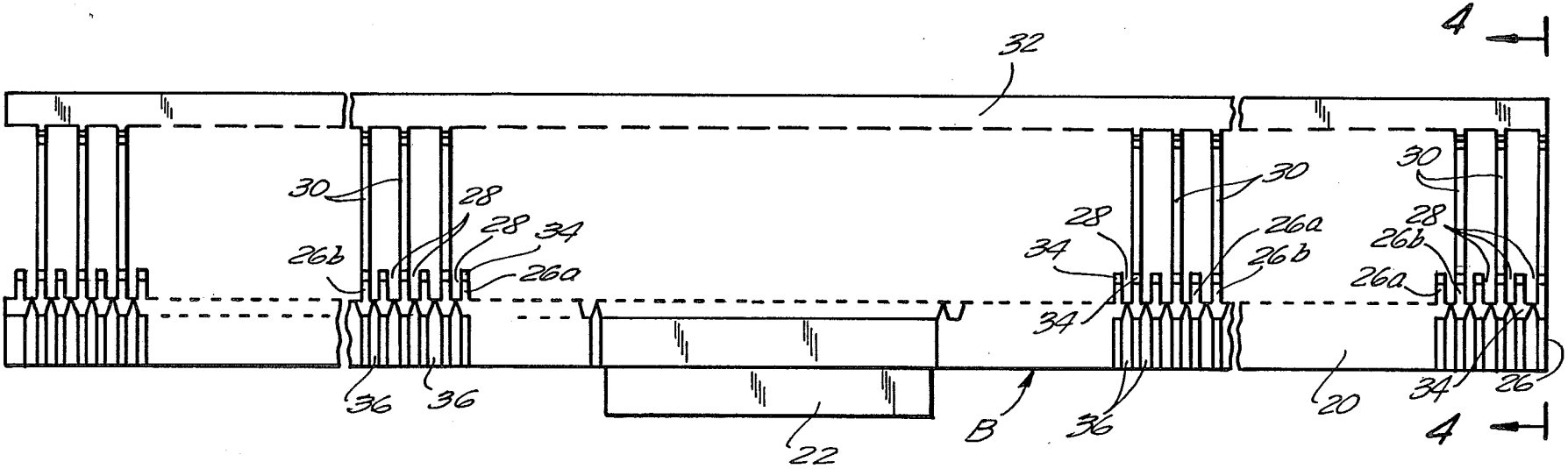
FIG. 3 is a top plan view of an embryonic protector of the present invention as it is molded.
Figure 4:
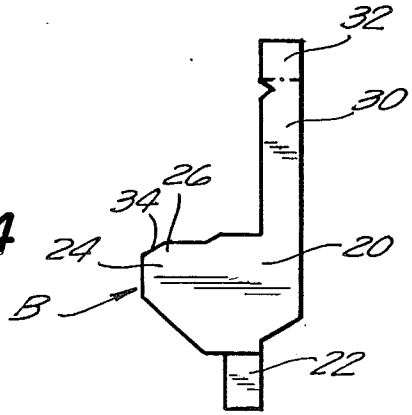
FIG. 4 is an end view thereof taken along the line 4—4 of FIG. 3.

The protector of the present invention, generally designated B and illustrated as such in FIGS. 3 and 4 is designed to be independently manufactured and then assembled with the connector A in such a way as to protect the terminal portions 12*a* and 12*b*. It comprises a body 20 having a length corresponding to the length of the terminal rows 14 and 16 on the connector with which it is to be associated. Extending rearwardly from that body 20 at least over a portion thereof is a flange-like projection 22 which functions as a handle or finger piece by means of which the protector B can be manipulated. Extending forwardly from the body 20 at the upper portion 24 thereof are a series of longitudinally spaced first wall-like parts 26 spaced from one another by a distance slightly greater than the diameter of the terminal portions 12*a* and 12*b* so as to define pockets 28 into which those terminal portions 12*a* and 12*b* are adapted to be received, the number of pockets 28 in the protector B corresponding to the number of terminal portions 12*a* and 12*b* in a given terminal row 14 or 16. Alternate ones 26*a* of the wall parts 26 extend vertically for only a short distance but alternate ones 26*b* of the wall parts 26 extend down to points below the lower edges of the wall parts 26*a* and relatively long finger-like parts 30 extend forwardly therefrom for appreciable distances. When the protector is molded the tips of those finger-like parts 30 communicate with a selvage strip 32 to facilitate molding, which strip is removed from the molded item before it is used, thereby to produce finger-like projecting parts 30 with free ends. The inner and upper portion of the walls 26 is provided with a downwardly and outwardly inclined surface 34. The outer portion of the upper surface of the body 20 may be provided with notches 36 appropriately spaced along the length of the body 20, as by registering with each of the pockets 28, so that the protectors B may be molded in a limited number of standard lengths and then cut down to size for use with a particular terminal A by severing or otherwise removing the unneeded ends of the molded connector, the notches 36 facilitating that operation.

Figure 8:
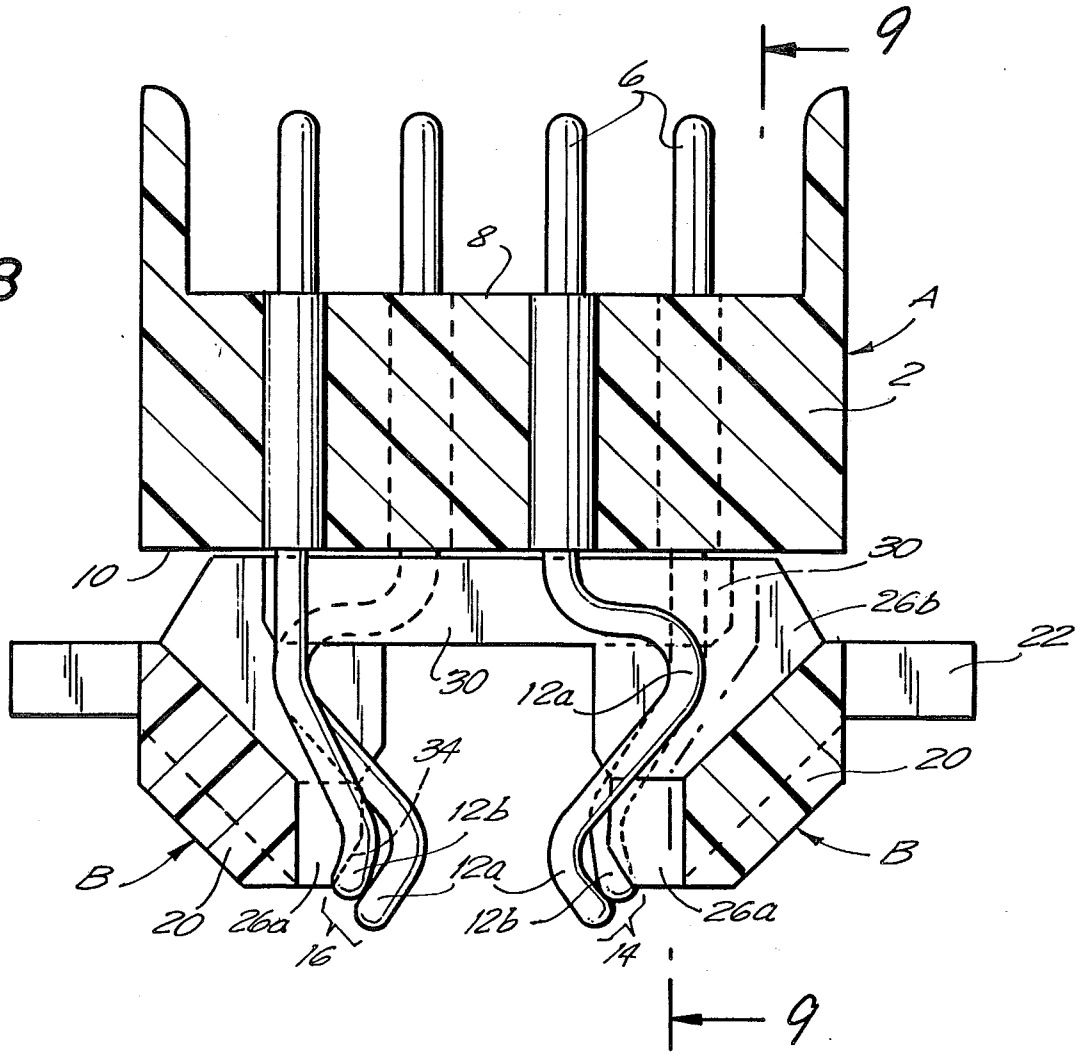
FIG. 8 is a view similar to FIG. 5 but on an enlarged scale and showing both protectors in position.
Figure 9:
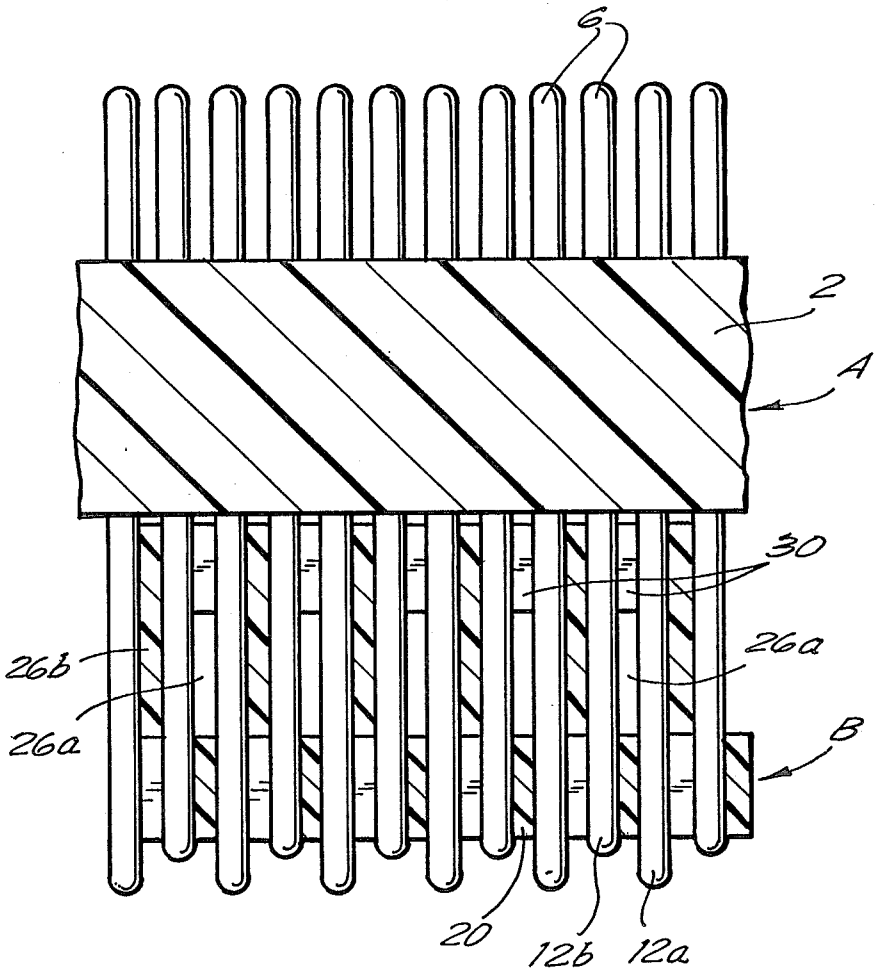
FIG. 9 is a cross-sectional view taken along the line 9—9 of FIG. 8.
Figure 10:
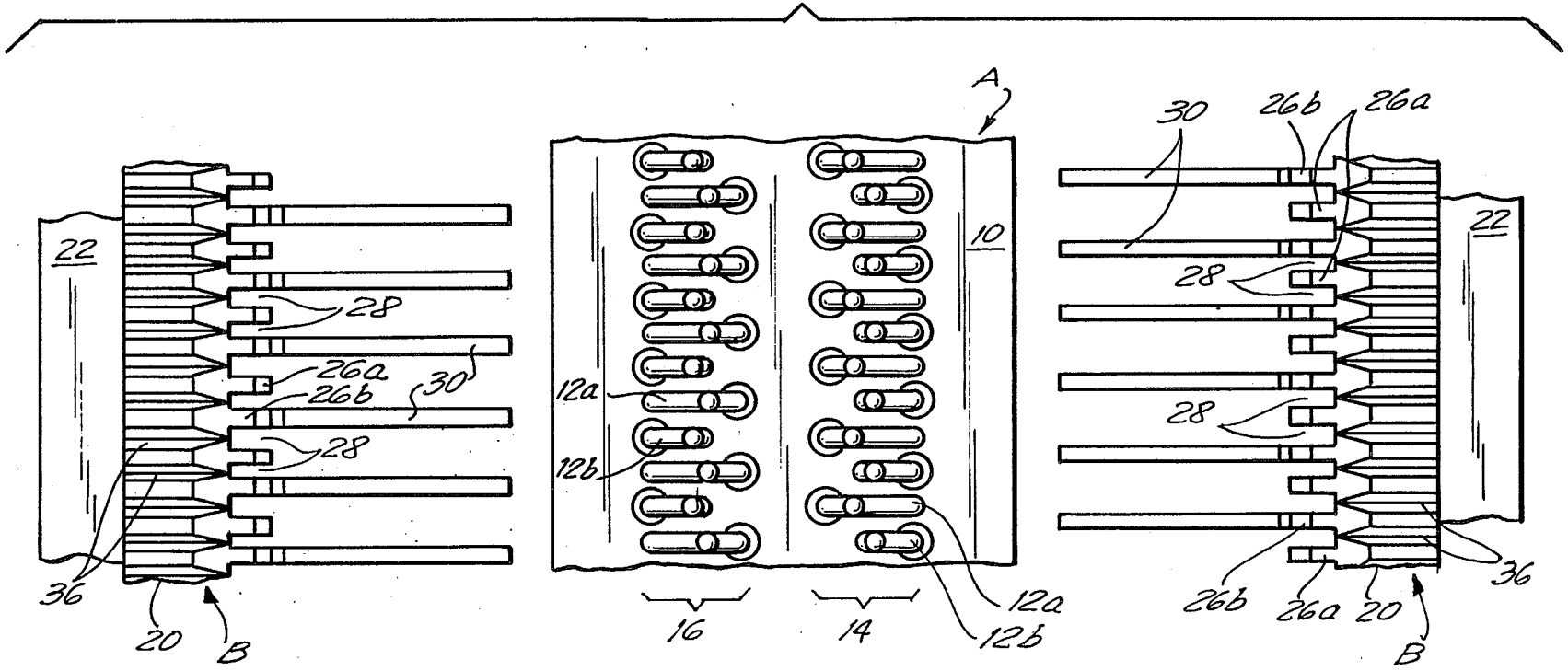
FIG. 10 is a bottom plan view of the connector and protectors of FIG. 5.
Figure 11:
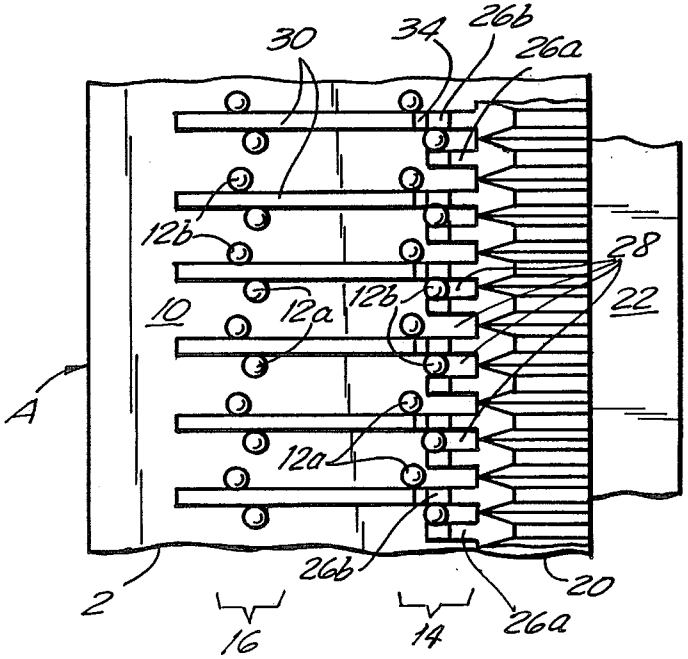
FIG. 11 is a bottom plan view of the connector and protector of FIG. 6.
Figure 12:
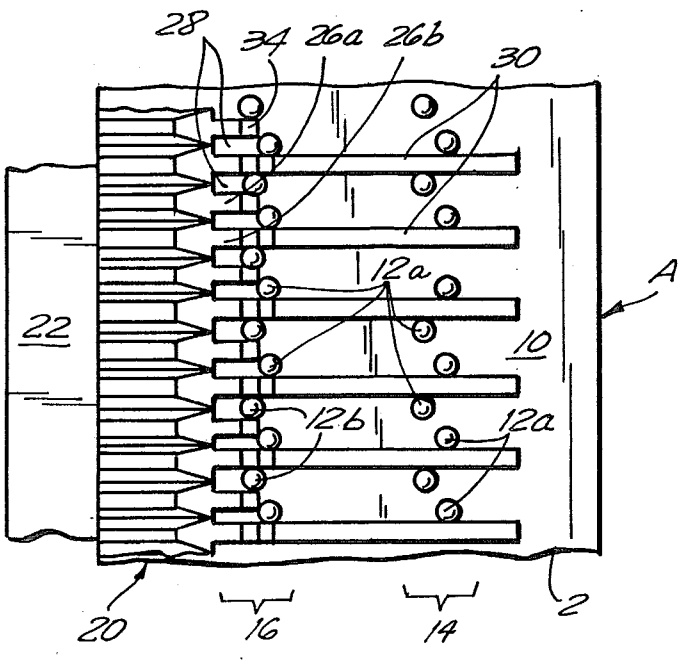
FIG. 12 is a bottom plan view of the connector and protector of FIG. 7.
Figure 13:
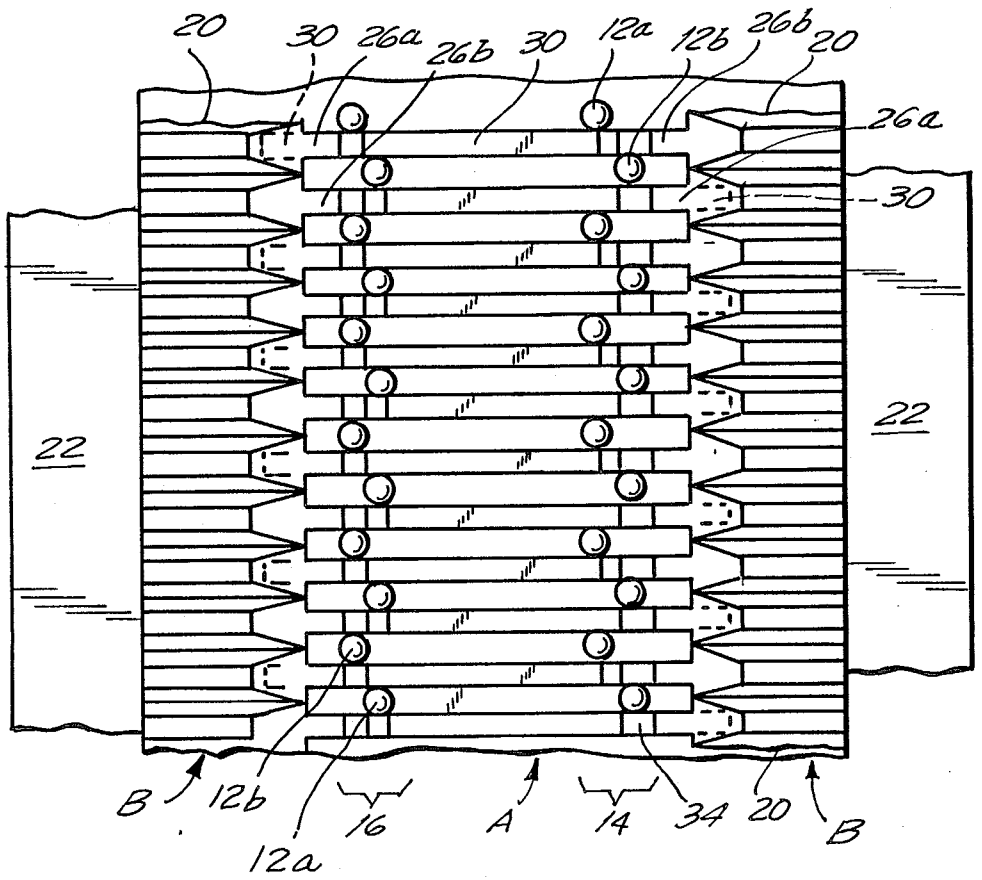
FIG. 13 is a bottom plan view of the connector and protectors of FIG. 8.

In use, and as may best be seen from FIGS. 5–13, a given protector B is associated with a given connector A by being slid laterally over the upper surface 10 of the connector body 2 until the terminal portions 12 are received in the pockets 28. A separate protector B may be used for each of the terminal rows 14 and 16, in which case the two protectors B will be so arranged that their finger-like projecting parts 30 alternate with one another along the length of the connector A. Thus, as may be seen from FIG. 6, when the right-hand protector B is inserted each of the external portions 12*a* and 12*b* of the right-hand row 14 will be received in a different pocket 28, and the finger-like portion 30 of that right-hand protector B will each extend to a position between a different pair of the terminal portions 12 of the row 16. As may be seen from FIG. 7, the same is true when the left-hand protector B is inserted, except that the finger-like portions 30 of that left-hand connector will be interposed between terminal portions 12 on the row 14 which alternate longitudinally with the terminal portions of the row 16 between which the finger-like parts 30 of the right-hand connector B are received. Thus, as shown in FIGS. 8 and 13, each of the terminal portions 12*a* and 12*b* of each of the rows 14 and 16 are received within a protector pocket 28, the finger-like parts 30 from each of the protectors B extend across the upper surface 10 of the connector A and interpose themselves between alternate pairs of terminal portions in the opposite row, and those finger-like portions 30 define a floor for the space 18 into which the circuit board is adapted to be received. As is perhaps best seen from FIGS. 6–8, parts of the terminal portions 12 are exposed in and may extend from their respective pockets 28, but other parts of the terminal portions 12 are housed within their respective pockets 28. Thus once the protectors B have been inserted the terminal portions 12 are protected against adverse external influences, and in particular are positively protected from bending toward or engaging adjacent terminal portions.

When a circuit board is to be associated with the connector A it is simply inserted into the space 18 between the terminals of the rows 14 and 16, as is conventional. The protectors B do not prevent that insertion; if they happen to be laterally inserted to such a degree that the inner surfaces of the walls 26 would interfere with the circuit board, the circuit board when being inserted will first engage the inclined surfaces 34 of the protector B and will then cam those protectors B laterally outwardly by a distance sufficient to permit the circuit board to be inserted. The fingers 30 define a floor for the space 18, and thus positively define the extent to which the circuit board may be inserted. All of this ensures accurate registration of each of the connector terminals 12 with the proper conductive pad on the circuit board. If soldering of the terminals 12 to the conductive pads on the circuit board is to be accomplished, any or all of the soldering procedures, including pre-dipping of the terminals 12 and the actual production of a solder joint, can be accomplished while the protectors B are in place. This represents a significant advantage, in particular ensuring that the soldering operation will not produce unwanted electrical connections between adjacent terminals.

Once the circuit board has been inserted and the electrical connections have been made in the desired fashion, protection of the terminals 12 is no longer as critical a matter as it was. The protectors B may, if desired, remain associated with the connector A when it is used, or they may be removed therefrom and, if appropriate, reused.

The protectors of the present invention may be readily and inexpensively manufactured; they add only an insignificant amount to the overall cost of the connector. They maintain terminal spacing during solder-dip processing to prevent solder bridging, they protect the terminals during shipping and subsequent handling at the user's facility, and they facilitate assembly with the circuit board, avoiding the necessity for individual terminal location for alignment with the appropriate circuit board pad. They isolate and position each terminal in its proper location prior to a solder-dip operation and then remain as part of the connector assembly during packaging and transportation, thereafter while the customer applies tee circuit board thereto, and thereafter remains in position through the solder-reflow process.

While but a single embodiment of the present invention has been here specifically disclosed, it will be apparent that many variations can be made therein, all within the scope of the present invention as defined in the following claims.

We claim:

1. In combination with a connector comprising a body along which a series of a conductive terminals are located in exposed fashion, said series of terminals collectively extending over a substantial length of said body and in a given configuration with spaces therebetween, a terminal protector removably associable with said connector and without which said connector can function in normal fashion comprising a body separate from said connector having a length and configuration corresponding to that of said series of terminals, and a series of first parts extending from said body and so arranged as to fit into spaces between exposed portions of adjacent terminals, thereby to define pockets into which said exposed portions of said terminals are received so as to minimize the possibility of distortion of said terminals from outside influences, and second parts located below and in line with some of said first parts and extending from said body in the same direction as said first parts extend and to points beyond the ends of said first parts, thereby to be interposed between adjacent ones of said terminals.

2. The combination of claim 1, in which said first parts extend from said body a distance such that said terminals when received in said pockets are normally exposed beyond the ends of said first parts.

3. The combination of claim 1, in which said second parts are located in alignment only with alternate ones of said first parts.

4. In the combination of either of claims 1 or 2, handle means extending from said body in a direction opposite to that in which said first parts extend.

5. The combination of either of claims 1 or 2, in which the portions of the upper surfaces of said first parts remote from said body are inclined downwardly and outwardly.

6. The combination of claim 1, in which said terminals are arranged on said connector in two laterally spaced rows, and in combination therewith two of said terminal protectors in each of which said first parts extend from said body a distance such that said terminals when received in said pockets are exposed beyond the ends of said first parts, second parts located below and in line with some of said first parts and extending from said body in the same direction as said first parts extend and to points beyond the ends of said first parts, said two protectors being assembled with said connector so that each is separately positionable on said connector body and associated with a different row of connectors with said second parts from one protector laterally offset with respect to the second parts from the other protector.

7. The combination of claim 6, in which said second parts are located in alignment with alternate first parts.

8. The combination of either of claims 6 or 7, in which the spaces between adjacent terminals of each row are substantially opposite one another, and in which, when the first parts of a protector enter the spaces between terminals of its associated row, said second parts of that connector extend from said body by an amount sufficient to at least partially enter the space between a pair of terminals of the other row.

9. In the combination of either of claims 6 or 7, handle means extending from said body in a direction opposite to that in which said first parts extend.

10. The combination of claim 6, in which the portions of the upper surfaces of said first parts of said protector remote from said body are inclined downwardly and outwardly.

11. A terminal protector adapted to be used with an electrical connector which has a series of exposed conductive terminals extending therefrom in a row and removably associable with said connector and without which said connector can function in normal fashion, said protector comprising an elongated body having a face adapted to be positioned alongside said row of terminals, a series of first parts extending from only an upper portion of said face a given distance so as to be interposed between adjacent terminals, and a series of second parts extending from a lower portion of said face a distance greater than said given distance, said second parts being fewer in number than said first parts and vertically aligned with individual ones of said first parts, thereby to be interposed between adjacent ones of said terminals.

12. The terminal protector of claim 11, in which said second parts are connected to said individual ones of said first parts by vertical extensions of said first parts.

13. The terminal protector of either of claims 11 or 12, in which alternate ones of said first parts constitute said individual ones.

14. In the terminal protector of either of claims 11 or 12, handle means extending from said body in a direction opposite to that in which said first parts extend.

15. The terminal protector of claim 14, in which alternate ones of said first parts constitute said individual ones.

16. The terminal protector of claim 11, in which the portions of the upper surfaces of said first parts remote from said body are inclined downwardly and outwardly.

17. An embryonic terminal protector comprising the protector of either of claims 1 to 2 in which at least some of said parts have ends extending from said body which are integrally connected to one another.

18. In the embryonic terminal protector of claim 17, handle means extending from said body in a direction opposite to that in which said first parts extend.

19. The embryonic terminal protector of claim 18, in which the portions of the upper surfaces of said first parts remote from said body are inclined downwardly and outwardly.

20. The embryonic terminal protector of claim 17, in which the portions of the upper surfaces of said first parts remote from said body are inclined downwardly and outwardly.

21. A terminal protector adapted to be used with an electrical connector which has a series of exposed conductive terminals extending therefrom in a row, said protector comprising an elongated body having a face adapted to be positioned alongside said row of terminals, said face having a given height, a series of walls parts extending form said face in a given direction for a given distance and adapted to be received between adjacent ones of said terminals, alternate ones of said parts extending vertically for a first distance which is a fraction of said given height and the other alternate ones of said wall parts extending vertically for a second distance greater than said first distance, and fingers extending outwardly in said given direction from lower portions of said other alternate ones of said wall parts and adapted to be received between adjacent ones of said terminals.

22. In the terminal protector of claim 21, handle means extending from said body in a direction opposite to that in which said first parts extend.

23. The terminal protector of either of claims 21 or 22, in which the portions of the upper surfaces of said wall parts remote from said body are inclined downwardly and outwardly.

24. An embryonic terminal protector comprising the protector of either of claims 21 or 22 in which said parts have ends extending from said body which are integrally connected to one another.

25. The embryonic terminal protector of claim 24, in which the portions of the upper surfaces of said wall parts remote from said body are inclined downwardly and outwardly.

26. In combination with a connector comprising a body along which a series of conductive terminals are located in exposed fashion, said series of terminals collectively extending over a substantial length of said body and in a given configuration with spaces therebetween, a terminal protector comprising a body having a length and configuration corresponding to that of said series of terminals, and a series of first parts extending from said body and so arranged as to fit into spaces between exposed portions of adjacent terminals, thereby to define pockets into which said exposed portions of said terminals are received so as to minimize the possibility of distortion of said terminals from outside influences, in which said terminals are arranged on said connector in two laterally spaced rows, and in combination therewith two of said terminal protectors in each of which said first parts extend from said body a distance such that said terminals when received in said pockets are exposed beyond the ends of said first parts, second parts located below and in line with some of said first parts and extending from said body in the same direction as said first parts extend and to points beyond the ends of said first parts, said two protectors being assembled with said connector so that each is associated with a different row of connectors with said second parts from one protector laterally offset with respect to the second parts from the other protector.

* * * * *